United States Patent [19]

Kenshol

[11] 4,325,512

[45] Apr. 20, 1982

[54] FLAME SPRAY GUN

[75] Inventor: Kenneth W. Kenshol, Berkeley, Ill.

[73] Assignee: Norton Company, Worcester, Mass.

[21] Appl. No.: 118,472

[22] Filed: Feb. 4, 1980

[51] Int. Cl.[3] ..... B05B 7/18

[52] U.S. Cl. ..... 239/84; 137/625.48; 239/414; 239/419.3; 251/324; 415/202

[58] Field of Search ..... 415/202; 251/324; 137/625.48 X; 239/79-85, 414, 419.3, 422, 428, 529

[56] References Cited

U.S. PATENT DOCUMENTS

| | | | |
|---|---|---|---|
| 2,190,575 | 2/1940 | Tabb | 137/625.48 |
| 2,659,623 | 11/1953 | Wilson | 239/83 |
| 2,963,033 | 12/1960 | Kenshol | 239/84 X |
| 3,073,528 | 1/1963 | Wilson et al. | 239/79 |
| 3,148,818 | 9/1964 | Charlop | 239/84 X |
| 3,179,371 | 4/1965 | Charlop | 239/84 X |
| 3,378,203 | 4/1968 | Stanton | 239/84 |
| 3,455,510 | 7/1969 | Rotolico | 239/85 |
| 3,545,906 | 12/1970 | Meneret et al. | 239/422 X |
| 3,902,663 | 9/1975 | Elmer | 251/324 X |
| 3,923,416 | 12/1975 | Frey | 415/202 X |

*Primary Examiner*—Andres Kashnikow
*Attorney, Agent, or Firm*—Walter Fred

[57] ABSTRACT

A flame spray gun (10) for feeding and melting rods (R) of heat fusible material and spraying molten droplets thereof onto a substrate comprising an improved main supply valve connected to air, fuel gas and oxidant conduits (14–22) (44–48) including air, fuel gas and oxidant inlet and outlet chambers (28–38), continuous seals (40) and vents (42) between the chambers, a valve shaft (50) with axially spaced slots movable within a bore and seals to connect the inlet and outlet chambers, a valve locking device (54–56) for maintaining shaft (50) either in a LIGHTING or ON position and an unlocking device (62–66) to release biased valve shaft to an OFF position. An improved combustion head (70) and flame spray nozzle (82) has seals situated on opposite sides of oxidant and fuel gas chambers and between the combustion head and nozzle. Further an improved turbine (130) comprises angularly spaced air jet passages in a shroud for simultaneously directing air under pressure from a surrounding sealed chamber against the turbine rotor (140) and axial exhaust passages between the air jet passages and a speed control for selecting, sensing and regulating the turbine comprises a throttle valve including differential pistons (172–174) responsive to back pressure created by movement of a magnet (160) within a magnetic cup (168) rotating with the rotor (140) which produces eddy current force torque which rotate the magnet (160) and an air jet obstructer (162) relative to an air jet orifice (164) and thereby vary the back pressure which acts to shift the throttle valve which adjusts the air supply and maintains the speed of the turbine accordingly to a constant preselected desired rate.

25 Claims, 6 Drawing Figures

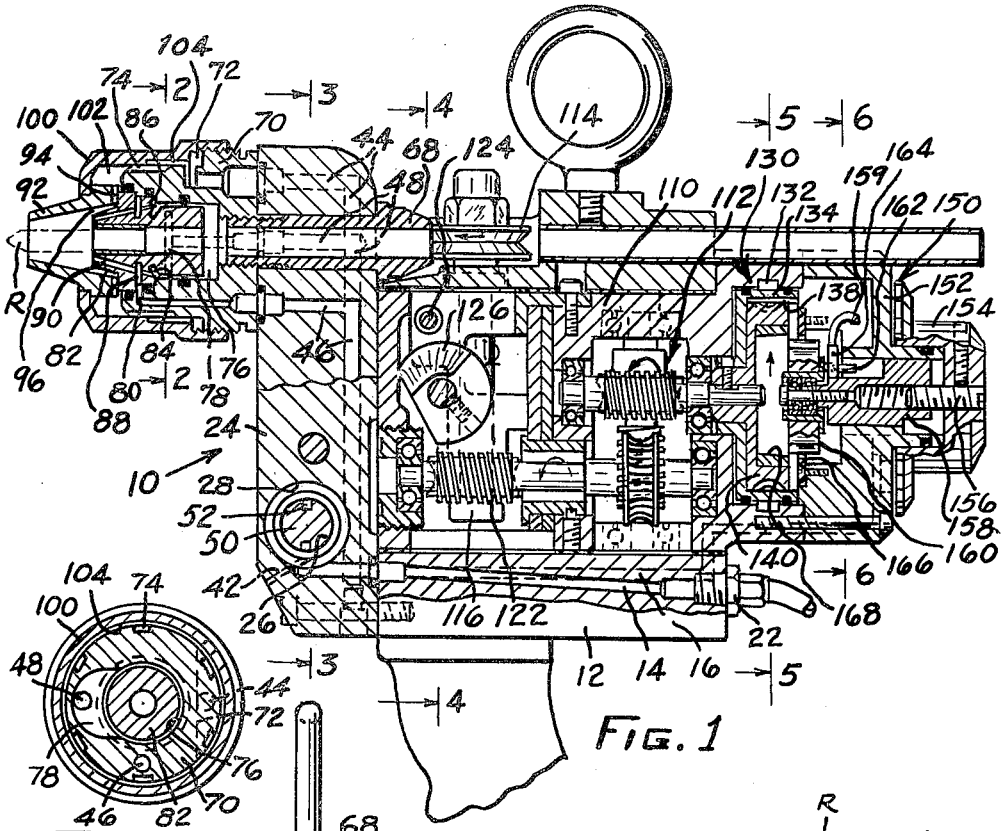
FIG. 1
FIG. 2
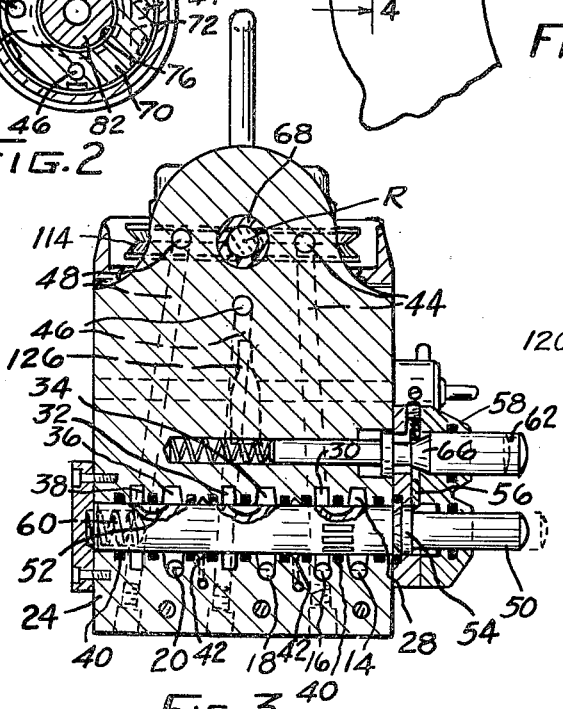
FIG. 3
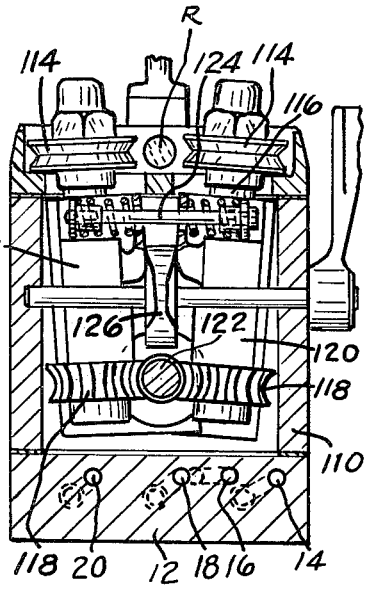
FIG. 4

FLAME SPRAY GUN

TECHNICAL DISCLOSURE

The invention relates to an improved flame spray gun for feeding melting and spraying heat fusible material initially in wire or rod form and particularly for applying fused refractory oxide coatings onto a substrate to protect and make it more resistant to various forms of attack.

BACKGROUND ART

The prior art discloses a number of improvements in combustion and plasma arc flame spray guns of the type through which heat fusible inorganic metal and ceramic or refractory wire or rod is fed, heat softened, atomized into molten droplets or particles projected onto a substrate to provide a coating thereon for various well known purposes and applications such as disclosed in U.S. Pat. No. 2,707,691 granted to Wheildon.

Heretofore, many attempts have been made to remedy a number of problems associated with flame spray guns. One such problem concerns itself with the air driven turbine and means regulating the speed thereof and hence the feed of the wire or rod at a relatively constant rate into the flame.

Another problem arises from improper mixing of the oxidant, fuel gas and the compressed air due to leakage by seals and hence between ports in the main supply valve and the flame spray nozzle. The result of which causes fluctuations in flame temperature and the supply of compressed air to drive the wire or rod feed turbine mechanism and to propel the molten droplets of the rod onto the substrate.

Thus, the object of the instant invention is to provide a more reliable and stable spray gun with improved supply valve means, flame spray nozzle means, sealing means, air turbine drive means and air turbine speed and feed regulating means.

DISCLOSURE OF THE INVENTION

A flame spray gun comprising a gun body including a base portion or manifold including fluid inlet passages is connected to regulatable source of supply under pressure and fixed to an upwardly extending front wall portion or manifold. The gun body supports fluid supply valve means including a valve shaft with axially spaced slots movable axially relative to spaced pairs of adjacent equally spaced inlet and outlet chambers and releasable locking means therefore. One of each pair of adjacent chambers is connected to a passage in the base manifold and the other to one to a number of spaced outlet passages extending upwardly to outlets angularly spaced around a rod guideway bore in an upper outlet portion of the front wall portion.

A combustion head fastened to the upper outlet portion of the front wall portion also has a rod guideway aperature and angular spaced passages aligned respectively with the rod guideway bore and angularly spaced passages in the front manifold.

The combustion head also has a stepped bore including a plurality of adjoining bores of different diameter into which a flame spray nozzle with adjoining mating step portions of interfitting diameter is inserted.

The nozzle has an annular mixing chamber or slot connected to the oxidant and fuel gas passages in the combustion head and a truncated cone shape forward end portion with angularly spaced inclined passages through which a combustible mixture of oxidant and fuel gas may pass and then ignited to provide a converging cone shape flame for melting a rod fed through a bore in the nozzle.

An air blast cap is mounted ahead and around the 35 cone shape forward end portion of the nozzle and is maintained in axial engagement therewith by an aircap retaining nut threaded to and surrounding the combustion head.

The combustion head, air cap retaining nut and air blast cap have connecting passages for introducing air under pressure into the air blast cap and about the cone shape nozzle to propel the melted droplets of the rod onto a substrate.

A gear housing portion of the gun body fastened to the base and front manifold houses and supports a gear train of worms and worm wheel gears connected to an external pair of opposing feed rolls and driven by an air turbine. The feed rolls are pivotally supported and resiliently biased toward each other into feeding engagement with a rod when a cam attached to a shaft and an external lever is rotated out of engagement with opposing cam follower surfaces on the feed roll supports.

An air turbine housing attached to the gear housing houses a stator or shroud and rotor including an annular magnetic cup connected to an input shaft of the worm gear train.

An annular groove connected by main supply passages to the main supply valve extends around the stator to angularly spaced fluid jet passages in the stator for directing air against the rotor blades. The air exhausts axially through angularly spaced exhaust passages situated adjacent the fluid jet passages and between the stator and rotor.

Turbine speed and feed control means housed within a turbine cover fastened to the turbine housing includes a rotatable knob and adjusting screw for shifting a nut and attached rotatable multiple pole magnet axially within and relative to a fixed multiple pole magnetic eddy yoke and the rotatable magnetic cup driven by the turbine wheel to vary magnetic force or attraction between the magnetic cup and the magnet.

Speed sensing means responsive to axial and rotary movement of the multiple pole magnet and changes in air pressure operates a throttle valve to increase or decrease the air supply and maintain the selected speed of the turbine at a constant rate.

BRIEF DESCRIPTION OF THE DRAWINGS

FIG. 1 is a vertical sectional view of the flame spray gun of the invention.

FIG. 2 is a cross sectional view through the combustion head and nozzle taken along line 2—2 of FIG. 1;

FIG. 3 is a cross sectional view through the front manifold and the main supply valve means taken along line 3—3 of FIG. 1;

FIG. 4 is a cross sectional view through the gear housing and the base manifold taken along line 4—4 of FIG. 1 and showing the feed roll mechanism pivoted to the deengaged position by the rotary cam;

BEST MODE OF CARRYING OUT THE INVENTION

Figure 5:
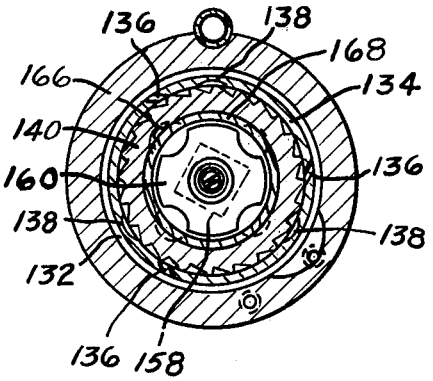
FIG. 5 is a sectional view through the air turbine taken along line 5—5 of FIG. 1.

Referring to FIG. 1 wherein is shown an improved flame spray gun 10 adapted to feed, and melt wire or rods of fusible materials and propel molten droplets thereof onto a substrate.

The assembled flame spray gun 10 comprises a gun body including a base portion or support plate and fluid intake manifold 12. The base portion 12 has conduit means comprising an air inlet passage 14 an air outlet passage 16, a fuel gas or acetalylene inlet passage 18 and an oxidant inlet passage 20 extending therethrough.

A plurality of conventional fittings and fastened flexible supply hoses are fastened to the inlet side of the passages 14, 18 and 20 in manifold 12 for connection to and conducting air, an oxidant and fuel gas under pressure from conventional regulatable sources of supply.

The gun body has fastened to the opposite end or side of the base portion or support plate manifold 12 an upwardly extending front wall portion support plate or main supply valve manifold 24. The manifold 24 has conduit means including passages which are extensions of the passages 14, 16, 18 and 20 each sealed against leakage by O-rings at the joints between the manifolds 12 and 24.

Alternatively, the base portion and manifold 12 and the front support plate, supply valve and manifold 24 could be made as integral parts of the gun body by casting and/or machining the gun body out of a integral block of material thus eliminating the joints and seals.

Main fluid supply valve means shown in FIG. 3 are provided comprising a valve bore 26 extending transversely in the front manifold 24 including a plurality of axially spaced annular chambers 28, 30, 32, 34, 36, 38 of larger diameter than the bore 26.

The annular chambers are sealed from one another by a plurality of axially spaced O-rings situated in annular recesses 40 adjacent each side of the annular chambers 28–38 and annular venting V-shaped recesses 42.

The annular chambers 28, 34 and 36 are connected respectively to the inlet passages 14, 18 and 20. Annular chambers 30, 32 and 38 are connected to and intersect respectively with the air passage 16 in the manifold 12 and air passage 44, fuel gas passage 46 and oxidant passage 48 extending upwardly to an outlet or front side of an opposite outlet end portion of the front manifold 24. In FIG. 1 the exit of air passage 44 is shown 90° out of position from its actual position shown in FIG. 2 and 3.

A valve stem or shaft 50 of circular cross section is slidably mounted in the bore 26 in sealing engagement with the O-ring seal in the annular recesses 40. The valve stem is provided with a plurality of axially as well as angularly spaced shallow slots 52 preferably of arcuate shape cut with a woodruff keyway cutter. The slots 52 are of sufficient number, depth, width and axial length about the axis of the stem to connect the annular chambers 28 and 30, 32 and 34 and 36 and 38 when the stem 50 is axially moved to the on position shown in FIG. 3.

Releasable locking means are provided for maintaining the valve shaft 50 in either an OFF, LIGHTING or IGNITING or an ON position comprising a short axial portion 54 of shaft 50 having a LIGHTING or IGNITING position tapered groove including a beveled or tapered cam surface adjoining a forward annular shoulder or radial surface and a rear annular shoulder surface engageable by the beveled end portion of a locking detent 56 moveable in a guideway or slot in a retaining end cap 58.

In the OFF position the valve stem 50 is biased from the ON position shown in FIG. 3 into engagement with the end cap 58 by a resilient member or spring 60 when the beveled end of the detent 56 has been raised out of engagement with the outer or rear annular shoulder of portion 54. The detent then moves into engagement with a portion of shaft 50 slightly beyond and to the left of the adjoining forward annular shoulder of the portion 54.

When the valve stem 50 is moved axially inwardly from the OFF position to the ON position shown in FIG. 3 the detent 56, first moves into the tapered LIGHTING position groove whereupon the valve shaft has moved sufficiently to allow a small amount of air, fuel gas and oxidant to leak or bleed from one end of the slots 52 and into the outlet chambers 30, 32 and 38. Following ignition, the valve stem 50 is again moved whereupon the tapered cam surface of the portion 54 raises the detent 56 which allows the portion 54 to pass by and the detent 56 to drop into engagement with the rear annular shoulder to maintain it in the ON position shown. Means for releasing the valve locking means and allow movement of the valve stem 50 to the OFF position comprises a resiliently or spring biased valve releasing plunger or shaft 62 slideably mounted in the manifold portion 24 of the gun body and the end cap 58.

The plunger 62 has a forward or inner end portion of reduced diameter moveable in an inner bore in the manifold 24 and a narrow axial center or intermediate portion moveable in a counter bore of relatively short axial length between the end cap 58 and an inner annular shoulder of the counter bore.

Adjoining the intermediate portion of the plunger 62 is a reduced portion extending axially to an adjoining tapered, or beveled cam portion 66 extending outwardly at an incline to the axis of plunger 62 to an outer end portion of larger diameter.

The plunger 62 is normally biased by a spring to the retracted or locking position shown in FIG. 3 with its intermediate portion abutting an inner annular stop surface of the end cap 58 with a bore of smaller diameter therein.

As shown in FIG. 3 the detent 56 which has moved or spring biased into a locking position has an internal surface about a central aperture or both of much larger diameter than the reduced portion adjoining the beveled cam portion 66 of the plunger.

Thus, the detent 56 is allowed to move relative to the reduced portion into the locking position shown. However, the diameter of the outer portion of the plunger 62 is about the same and preferably slightly smaller to allow it to pass through the bore in dent 56.

The detent 56 is released, raised or moved out of the locking position by the engaging cam portion 66 when the plunger 62 is moved inwardly against the spring. Hence, the withdrawal of the dent 56 allows the valve stem 50 to move outwardly to the OFF position against the cap 58 under the influence of the spring 60. Upon releasing the plunger 62 the dent 56 is allowed to move into engagement with the portion of the valve stem 50 slightly to the left of the forward annular shoulder on portion 54.

Means are provided for guiding wire or rod through the front manifold 24 including a hollow guide bolt 68 extending through a central aperture in the upper end portion of the front manifold 24.

Means for providing an ignitable combustible mixture, melting and propelling molten droplets of a heat flusible wire or rod comprises a combination head or body 70 fixed, threaded, or bolted to the upper end portion of the front manifold 24. Preferably the hollow wire or rod guide bolt 68 has a head at an entrance end thereof engaging the rear or inner side of the manifold 24 and an opposite threaded end portion extending beyond the front side of manifold 24 threaded into the central portion of the combustion head 70.

The combustion head 70 has a plurality of annularly spaced passages which are extensions of, connected to and aligned with the air, fuel gas and oxidant passages 44, 46, and 48 in the front manifold 24. O-rings seals are provided at the exit end of the passages 44, 46 and 48 in manifold 24 to prevent leakage at the joint between connecting passages, the front manifold 24 and the combustion head 70 bolted thereto.

Referring to FIG. 1 and 2 the combustion head 70 has an exterior slot 72 with an inlet side connected to the extension of air passage 44 and outlet side connected by an internal annular chamber or passage in an outer air cap retaining nut to equally angularly spaced exterior slots or passages 74 in the front outer peripheral portion of the combustion head 70.

The combustion head has a central multiple step bore 76 comprising a smaller size inner recess or bore, an intermediate size recess or bore and a larger size outer resess or bore including adjoining annular shoulders or surfaces which increase in diameter from the smaller inner to the larger outer recess or bore.

A first internal slot 78 in the head 70 has an inlet side connected to the exterior of the oxidant passage 48 and outlet side connected to the smaller inner recess or bore of the multiple step bore 76.

A second internal slot 80 in the combustion head 70 connects the intermediate recess or bore to the extension of the fuel gas passage 46. Each of the recesses or bores has an annular slot in which is mounted and O-ring seal for sealing engagement with the smaller inner, intermediate and outer larger size mating stepped surface portions of a flame spray nozzle 82 inserted into the stepped bore 76.

The nozzle 82 has a central aperature or bore with a replaceable wear resistant tubular liner therein through which the wire or rod about ¼ of an inch (6.35 mm) in diameter is passed to a flame to be melted and sprayed. An inclined oxidant receiving slot or chamber 84 extends around and into the intermediate portion of the nozzle 82. The inclined chamber 84 is connected to the oxidant slot 78 and passage 48 by an annular space of from 0.005 to 0.010 of an inch (0.127 to 0.254 mm) extending around and between the internal surface of the inner bore or recess and the external surface of the inner smaller diameter of the nozzle 82.

The chamber 84, annular passage and slot 78 are situated between and hence sealed off by the inner and intermediate O-ring seals to prevent leakage of the fuel gas.

A plurality or about twelve (12) equally angularly spaced oxidant injection passages 86 of relatively smaller, size, or diameter extend around the axis and bore of the nozzle 82 and axially from the inclined chamber 84 through the intermediate annular step portion to an annular oxidant and fuel gas receiving and mixing chamber 88. The mixing chamber 88 is situated between the intermediate and larger outer annular portion of the nozzle 82 and sealed off by the engaging intermediate and outer O-ring seals to prevent leakage.

Extending from the annular mixing chamber 88 and through a truncated cone shape front or exit end portion of the nozzle 82 are a plurality or about twelve (12) inclined passage 90 equally angularly spaced around the axis and bore of the nozzle for conveying a combustible mixture of the oxidant and fuel gas through the nozzle 82. The inclined passages 90 are relatively larger than and axially aligned with the inclined oxidant injector passages 86.

Preferably the passages 90 are about 0.028 of an inch (0.711 mm) in diameter and the oxidant injection passages 86 are about 0.135 of an inch (0.3425 mm) in diameter and inclined at an angle of about 19° to the axis.

Spaced from and encompassing the forward truncated cone shape portion of nozzle 82 is a truncated cone shape hollow air blast cap 92 with an internal truncated cone shape bore and surface inclined about 10° inwardly toward the axis and the smaller outlet end of the air cap.

The air cap 92 has an annular flange and an annular rear surface including a plurality or about six (6) radial air passages or slots 94 angularly space around the larger inlet end of the bore and held in engagement with the annular front surface of the larger outer step portion of the nozzle 82.

An annular conical or tapered space 96 between the air cap and nozzle is connected to and by the slots 94 to an air chamber adjoining the outlet end of the air slots 74 in the outer front peripheral portion of the combustion head 70. Air under pressure passed through the space 96 provide an annular cone shape curtain of air around and converging toward the end of the melted rod to propel molten droplets thereof onto a substrate.

Retaining means are provided for maintaining the air cap 92 and the nozzle 82 in axial alignment and axially clamped to the combustion head 70. The retaining means comprises a hollow outer air cap body or nut 100 including an internally threaded rear portion screw threaded to the outer threaded portion of the combustion head 70.

Retaining nut 100 also has a forward wall with a central bore and internal surface therein which encompasses a substantially concentric outer cylindrical surface of the air cap adjoining and engaging the annular flange portion of the air cap 92.

Thus, the close fitting bore and internal surface in the forward wall of the retaining air cap 100 tends to axially align and centralize the air cap relative to the nozzle 82 and combustion head 70.

Adjoining the forward wall of retaining nut 100 is a relatively large internal two step bore including a smaller inner chamber 102 adjoining a larger rear chamber 104 and internal surfaces which surround the front outer slotted peripheral portion of the combustion head 70. An annular portion of the forward smaller chamber 102 of the two step bore connects radial air slots 94 to the axial slots 74 which in turn are connected by an annular space portion of the larger rear chamber 104 to the slot 72 and air passage 44.

Thus, it can be seen that the various O-ring seals provided at the connection and joints engaging the main supply valve stem 50 and the large, intermediate and smaller size cylindrical surface portions of the nozzle 82 prevent loss due to leakage, cross leakage between parts and hence unintentional premixing of the air, oxidant and fuel gas. Also, the V-shape grooves 42 in the main fluid supply valve bore will further prevent any cross mixing of fluids by intercepting and venting to the exterior any leakage which might get by the o-ring seals.

Drive means are provided for feeding wire or rods through the flame spray nozzle 82 and into a combustible flame to be melted and droplets thereof propelled by the converging blast of air onto a substrate.

The drive means comprises a gear housing or portion 110 of the gun body and intervening sealing gaskets fastened as by bolts to the base and front manifold 12 and 24 respectively. A gear train 112 is provided including bearings, worms and worm wheels, shafts and feed rolls rotatably and axially supported in the conventional manner in the gear housing 110.

Referring to FIGS. 1 and 4 the output side of gear train 112 comprises a pair of opposing feed rolls 114 pivotable into and out of frictional engagement with opposite sides of a wire or rod R.

The feed rolls have V-grooves and are attached to shafts 116 extending from opposing worm gears or wheels 118 rotatably supported in a pair of feed roll support brackets or housing 120 pivotably mounted in the gear housing 110 for movement about the axis of the output worm shaft and worm 122 engaging the worm wheels 118.

It can be seen that the support brackets 120 have overlapping pivot potions and can pivot toward and away from each other while maintaining the worm gears 118 in engagement with the output worm 122.

Resilient means are provided for biasing and pivoting the support brackets 120 and feed roll 114 toward each other and into driving engagement with the wire or rod R. The resilent means comprises a bolt 124 extending through aperatures in cam follower engaging portions or lugs on the supports 120 engaged by compression springs situated between spring guide collars or bushings at opposite ends of the bolt. One spring guide collar engages the head of the bolt and the other is threaded onto the opposite threaded end of the bolt 124 which can be adjusted to increase or decrease the biasing spring pressure and hence the frictional engagement of the feed roll 114 with the wire or rod R.

Means to disengage the feed rolls 114 from the rod R comprises a rotary cam mechanism or unit 126 including a rotary cam, fixed to an intermediate portion of a shaft rotatably rotably mounted in the housing 110 and fixed to an actuating lever or handle outside the housing. The rotary cam is situated between and engages the cam engaging portions of the support brackets 120 and has a tapered circumferential portion or angular segment which decreases from a maximum to a minimum axial thickness. In the angular position shown in FIGS. 1 and 4 the lever has been moved upwardly to a vertical position whereupon the thicker or maximum axial thickness of the rotary cam spreads the supports 120 and feed rolls apart out of engagement with the rod R. Rotating the lever clockwise to the horizontal position moves the narrower or minimum axial thickness of the rotary cam between the cam engaging surfaces which allows the springs to bias supports 120 and feed rolls 114 into engagement with the rod R.

The drive means further includes an air or fluid driven turbine 130 mounted within a turbine rotor receiving bore including an annular air or fluid supply passage, recess groove 132 in the rear portion of the housing 110. A turbine shroud or stator 134 is fixedly mounted within the bore and has a pair of axially spaced external grooves and O-ring seals therein engaging axially spaced internal surface portions of the turbine receiving bore at opposite sides of the annular air supply groove.

Also, shroud 134 has a plurality or preferably three (3) equally angularly spaced air or fluid jet passages 136 and closely adjacent axially extending air exhaust passages 138. The air jet passages 136 simultaneously convey and direct air under pressure from the annular space to equally angularly spaced peripheral buckets or pockets and integral blades of a rotatable turbine rotor or wheel 140 fixed to rotate the input worm shaft of the gear train 112.

When the main supply valve 50 is actuated air under pressure in passage 16 eventually reaches the annular passage 132 and air jet passage 136 to provide jets of air of sufficient force to rotate turbine wheel 140, gear train 112 and feed rolls 114.

Preferably, the exhaust passage 138 are angularly spaced about 120° apart and about 30° or $\frac{1}{4}$ the angular distance between the jet passages 136 from the exit end of the jet passages 136 cooperating therewith whereby air is allowed to exhaust axially from the blades of the turbine wheel 140 shortly after it engages the turbine wheel 140 and thereby lower the amounts of and resistance of the air trapped between the shroud and turbine wheel and hence reduce the force required to rotate the turbine wheel 140. However, the exhaust passages may be located anywhere between and in most cases up to one half the angular distance between the jet passage 136.

Adjustable speed control means 150 are provided to sense, regulate and maintain the speed of the turbine wheel 140 and hence the feed rolls 114 at a substantially constant preselected rate.

The speed control or regulating means 150 comprises a turbine cover and/or speed regulating housing 152 bolted or fixed to the rear or back end of the gear housing 110. A speed setting dial 154 including a feed screw 156 fixed thereto is rotatably mounted and retained in axial position on a cylindrical rear portion of the regulating housing or cover 152 by a pair of pins fixed to the dial 154 extending into and rotatable within an annular groove in the rear portion of the housing cover 152.

Within the cylindrical portion of the cover or housing 152 is a polygonal shape bore, preferably a four sided feed nut bore, extending axially between opposite open ends thereof in which a non-rotatable similarly polygonal shape feed nut 158 is slideably mounted.

At an outer end portion of the feed nut 158 is an internal threaded hole engaged by the feed screw 156 that is held against axial movement but rotatable with the dial 154 to shift the feed nut 158 axially in the polygonal feed nut bore.

A salient radial multiple or four pole permanent magnet 160 is rotatably mounted on bearings and fixed axially with a threaded bolt to the reduced inner opposite cylindrical end portion of the axially moveably feed nut 158. A pin 162 fixed to and rotatable with the magnet 160 extends axially from outer side of the magnet 160 into the path and beyond a air jet nozzle or hollow tube 164 having an air jet orifice, or aperature in the tube wall. The tube 164 is fixed to and extends upwardly from an intermediate flat surface portion of the feed nut 158 to an open end connected to one end of a short flexible tubing or hose 159. Extending around the rotatable four pole magnet 160 is a stationary four pole magnet shunt or stator 166 fixed to recessed surfaces of angular spaced radial ribs or portions separating turbine air exhaust chambers and rear openings in the cover or housing 152.

Within the turbine rotor or wheel 140 is fixedly mounted an annular inwardly tapered magnetic cup 168 into and relative to which the rotatable magnet 160 can be moved axially to sense and regulate the speed of the turbine rotor 140.

More specifically the dial 154, feed screw 156, feed nut 158, four pole rotatable magnet 160, pin 162, orifice tube 164, magnetic stator or shunt 166 and the rotatable magnetic cup or ring 168 comprise a speed sensing means responsive to fluctuations in the speed of the turbine rotor or wheel 140. The speed sensing means is connected to speed control means 170 responsive to the sensing means to constantly regulate and deliver a substantially constant preselected amount of air under pressure to drive the turbine rotor 140.

Figure 6:
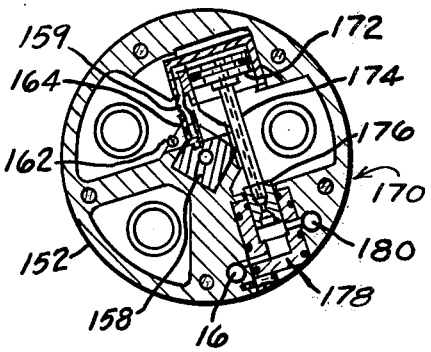
FIG. 6 is a sectional view through the turbine speed control means taken along line 6—6 of FIG. 1.

The speed control means also comprises as shown in FIG. 6 throttle means including an air pressure responsive force multiplying or increasing piston 172 including an annular groove and an O-ring seal slideably mounted in a speed control cylinder fixed within a chamber in the turbine cover or speed regulator housing 152. A hollow piston rod or tube 174 is fixed at one to a central bore in the piston 172 and at its opposite end to a relatively small speed control valve seat or throttle valve piston 176. The piston 176 which has an internal central aperature intersected by a transverse outlet slot or port and external annular grooves with O-ring seals therein is slideably mounted within a small central bore in a control valve supply port cylinder 178 fixed in an axially aligned bore in the turbine cover 152. A plurality of axially spaced annular grooves and O-rings seals are provided on the exterior of the supply port cylinder 178 which sealingly engages the internal surface of the cylinder bore in the cover 152 to provide O-rings seals on opposite sides of axially aligned air inlet and outlet transverse slots or passages in the cylinder 178 and intersecting the bore in the cover 152. The air inlet passage is connected to the main air passage 16 from the main supply valve 50 and the outlet passage 180 extends to a radial passage intersecting the annular turbine rotor air supply groove 132.

Referring to FIGS. 5 and 6 air under pressure from inlet passage 14 and the main supply valve 50 passes through passage 16 into the side inlet slot and internal bore in the cylinder 178. From the internal bore the air under pressure passes through the outlet slot and passage 180 to the turbine rotor and also through the small central passage or orifice in the control valve piston 176, the tubular piston rod 174 and piston 172 to side vent or outlet connected to and extending from the closed end of the cylinder chamber adjoining the larger force multiplying end surface area of the piston 172 house therein. The opposite outlet end of the side vent is also connected to the opposite end of flexible tube 159 connected to the orifice tube 164 moveable with the feed nut 158.

Referring to FIG. 5 the opposite poles of the rotatable magnet 160 and the poles of the stationary magnetic yoke or shunt 166 are attracted to one another by magnetic lines of force which maintain them in angular and radial alignment or idle position and which must be overcome by other outside forces if relative angular movement between them is to occur. Those outside forces are the jet of air issuing from the orifice tube 164 and against the pin 162 and the eddy force torque created by the rotating magnetic cup 168 which acts to angularly advance the magnet 160 and pin 162 in the same direction the turbine rotor rotates and the pin 162 closer to the outlet end of the air jet orifice in the tube 164.

However, the eddy force torque is counteracted by an opposite restoring force developed between the magnet 160 and the stationary magnetic yokes or shunt 166. The opposing forces quickly reach equilibrium and determine the exact angular position of the magnet 160 and pin 162 with respect to the air jet orifice in tube 164 at any given speed of the turbine.

Turning dial 154 and screw 156 in one direction shifts feed nut 158 and magnet 160 axially further into the cup 168 and thereby increase the eddy force torque and hence the angular displacement of magnet 160 and pin 162 toward the air jet tube 164 will be greater at equilibrium.

Conversely, turning dial 154 and screw 156 in an opposite direction withdraws the feed nut 158 and magnet 160 axially away from the cup and hence reduces the eddy force torque and the angular displacement of the magnet 160 and pin 162 at equilibrium. Thus in the extreme outward axial position the speed of the turbine 140 and magnetic cup 168 has the least influence on the magnet 160 and the maximum influence thereon when the magnet 160 is in the extreme inward axial position. Also, under the least amount of influence the pin 162 is furtherest away from the air jet orifice in tube 164 and therefore the air can exhaust freely without creating a significant amount of back pressure in the air supply passing through and from piston 172.

However, at maximum influence the pin 162 is closest to the air jet orifice in pin 164 and creates the greatest resistance to exhaust and hence the maximum amount of back pressure in the air supply. The force of back pressure reacts against the larger surface area of piston 172 which multiplies that force to provide a total differential force greater than the opposing force exerted by the relatively smaller area of throttle valve piston 176. As a result throttle piston 176 moves axially to a position of equilibrium to reduce the size of the turbine air supply outlet port and passage 180 and hence reduce the speed of the turbine 140 and feed rolls 114. Conversely when the back pressure is reduced the force exerted by the piston 172 is reduced and throttle piston 176 moves axially to a position of equilibrium which increases the size of the outlet air supply port and speed of the turbine 140 and feed rolls 114.

Thus any fluctuation in turbine speed air pressure or air supply is quickly sensed, responded to and corrected by the responsive movements of the throttle valve piston 176 to maintain speed of the turbine and feed rolls constant.

With the exception of a number of improvements, some of the components and operation of the improved flame spray gun disclosed hereinabove are similar in many respects to the flame spray gun disclosed in applicants prior U.S. Pat. No. 2,963,033 to which reference may be had for details not described hereinabove.

Although the flame spray gun 10 of the invention will accept melt and spray various kinds of heat fusible spray material in wire or rod form, it is particularly suited for accepting melting and spraying inorganic refractory material presented thereto in rod form.

Suitable flame spray rods of various inorganic refractory oxide materials known in the trade as "Rokide" rods are commercially available from Norton Company, Worcester, Massachusetts and sold under their registered trademark "ROKIDE". A number of suitable inorganic refractory rods and the compositions thereof are disclosed in U.S. Pat. Nos. 2,707,691; 2,876,121; 2,882,174; 3,171,774 and 3,329,558.

Operation of the spray gun 10 requires the usual hook up of the gun 10 to the air, oxidant and fuel gas flexible supply hoses 22, preadjusting the conventional regulating valves associated with the various sources of supply to supply predetermined volumes of air, oxidant, and fuel gas at predetermined pressures to the main supply valve 50.

The spray gun has a handle by which it can be held and also a ring by which it is usually attached to the end of a rod, rope or cable fastened to a nearby support and positioned adjacent the substrate to be coated. The main supply valve stem 50 is moved inwardly a short distance whereupon latch or detent 56 moves into the tapered groove and maintains the valve stem 50 in the LIGHTING position. The low volume of combustible mixture issuing from the nozzle is then ignited. Following ignition the valve stem 50 is shifted to the full ON position whereupon the detent or latch is moved out of the tapered groove and then biased into engagement with shoulder of portion 54 to maintain it in the ON position. Hence, air under presure is supplied to the air blast cap, 92 and through the throttle means 170 to the orifice tube 164 and the air driven turbine rotor 140. Oxidant such as oxygen and a fuel gas such a oxyacetylene is also supplied to the combustion head and mixed in the nozzle to provide a combustible mixture issuing from the nozzle 82. Thus, ignition of the combustion mixture provides a flame of sufficient temperature to melt a rod of refractory oxide material fed to it.

A wire or rod R is then inserted into the guide tube on the gun body and passed between the feed rolls which are released into frictional driving engagement therewith by rotating the lever downwardly and hence the rotary cam 126 out of engagement with feed roll supports 120.

Rod R is then fed through the combustion head, nozzle and into the flame at a constant selected rate determined by rotating the dial 154. The flame projects against and melts the advancing end of the rod to a fluid molten state or mass moving into a blast of air issuing from the air cap 92.

The blast of air contacts and breaks the molten mass up into a plurality of molten droplets and propels them against the substrate to be coated therewith.

Further, the flame spray gun of the invention is also adaptable for receiving interchangeable nozzles and special application attachments for spraying various types and sizes of wire or rod material at specific rates onto difficult to reach external and internal surfaces of a workpiece. For example, the gun of the invention can obviously be provided with a suitable intermediate tubular extension, between combustion head 70 and body portion 24, and air cap assembly similar to that disclosed in U.S. Pat. No. 2,769,663 for spray coating one or more internal surfaces of a tubular or hollow type workpiece.

Also, it is to be understood that the terms "fusible material" "wire" and "rod" as used hereinabove and in the appended claims are meant to include the various known flame sprayable fusible metals, plastics, ceramics and refractory materials, mixtures, alloys, laminates and composites thereof in wire or rod like forms including rigid, flexible, solid, tubular, porous, perforated and encased powder rod, wire, cord, strands and ribbon whether of short individual length or long length folded into a bundle, rolled or coiled into a roll.

As various possible embodiments of and modifications might be made in the embodiments of the invention disclosed hereinabove, it is to be understood that all matter described herein and shown in the accompanying drawings is to be interpreted as illustrative and not in a limiting sense.

I claim:

1. A flame spray gun having a gun body including a base portion, a front wall portion supporting a combustion head including a flame spray nozzle and an air blast cap, and a housing portion supporting adjustable drive means including a turbine, a gear train, speed control means and feed rolls for engaging and feeding a wire or rod of material through a guideway opening in the combustion head and nozzle to be melted by a flame and sprayed by a blast of air onto a substrate and conduit means for supplying air to the air cap and turbine and an oxidant and fuel gas to the flame spray nozzle from regulatable sources of supply under pressure, wherein the improvement comprises:

valve means connected to the conduit means and the gun body for selectively and simultaneously either cutting off or supplying air to the air blast cap and turbine and the oxidant and fuel gas to the flame spray nozzle from the regulatable sources of supply under pressure comprising:

a bore;

air, oxidant and fuel gas inlet chambers axially spaced in the bore and connected to respective air, oxidant and fuel gas inlet passages of the conduit means connectable with the sources of supply;

air, oxidant and fuel gas outlet chambers adjacent the respective air, oxidant and fuel gas inlet chambers in the bore and connected to respective air, oxidant and fuel gas outlet passages of the conduit means connectable with the air cap and flame spray nozzle;

seal retaining grooves between and adjacent each side of the air, oxidant and fuel gas inlet and outlet chambers;

a continuous seal in each of the seal retaining grooves; and a valve shaft including axially spaced slots of predetermined axial length and radial depth axially moveable within the bore and the continuous seals to an ON position whereby the slots simultaneously connect the air, oxidant and fuel gas inlet and outlet chambers.

2. A flame spray gun according to claim 1 wherein the valve means further comprises:

a plurality of venting grooves each situated in the bore between a pair of adjacent axially spaced continuous seals and connected by a vent passage to the exterior of the gun body for venting to the atmosphere any cross leakage of the air, oxidant and fuel gas by the continuous seals and thereby prevent mixing of the air, oxidant and fuel gas.

3. A flame spray gun according to claim 2 wherein the valve means further comprises:

resilient means for biasing the valve shaft and slots therein to an OFF position in the bore whereby the air, oxidant and fuel gas outlet chambers are disconnected from the inlet chambers and sources of supply.

4. A flame spray gun according to claim 3 wherein the valve means further comprises:

releasable locking means attached to the gun body for engaging and maintaining the valve shaft and slots therein in an ON position after the valve shaft has been moved a predetermined axial distance against the resilient means to a position in the bore whereby the slots connect and maintain the air, oxidant and fuel gas outlet chambers connected to the inlet chambers and sources of supply.

5. A flame spray gun according to claim 4 wherein the releasable locking means comprises:

a locking detent retained and moveable in a guide slot into engagement with a shoulder surface on the valve shaft after the valve shaft and shoulder surface has been moved axially to the ON position and aligned with the locking detent.

6. A flame spray gun according to claim 5 wherein the locking detent has a side portion for engaging and abutting the shoulder surface on the valve shaft;

a beveled end surface which extends from the side portion and tapers outwardly from the axis of the valve shaft to an opposite side portion of the locking detent; and wherein the valve shaft has a tapered groove including an adjoining tapered cam surface situated a predetermined axial distance from the shoulder surface and which tapers inwardly toward the axis of the valve shaft to an adjoining radial surface extending radially to a peripheral surface of the valve shaft for receiving and engaging the beveled end surface of the locking detent when the valve shaft is moved a short axial distance from the OFF position to a LIGHTING position and aligned with the locking detent moveable by the engaging tapered cam surface and into engagement with the shoulder surface when the shaft is moved axially from the LIGHTING position to the ON position.

7. A flame spray gun according to claim 6 wherein the valve means further comprises:

valve releasing means for disengaging the locking detent from the shoulder surface of the valve shaft and allowing the resilient means to move the shaft and shoulder surface to the OFF position and against stop means.

8. A flame spray gun according to claim 7 wherein the valve releasing means comprises:

a release shaft slideably mounted relative to the gun body and the locking detent and having a reduced intermediate portion extending axially through an opening adjoining an internal surface in an opposite end portion of the locking detent moveable to position the opening and internal surface out of axial alignment with an axis of the release shaft and a portion of the internal surface closer to the reduced intermediate portion, and a tapered cam portion adjoining and diverging from the reduced portion outwardly relative to the axis of the release shaft to an adjoining relatively larger portion whereby axial movement of the release shaft from a locking position to an unlocking position causes the tapered cam portion to engage the internal surface and shift the locking detent out of locking engagement with the shoulder surface of the valve shaft.

9. A flame spray gun having a gun body including a base portion, a front wall portion supporting a combustion head including a flame spray nozzle and an air blast cap; and a housing portion supporting adjustable drive means including a turbine, a gear train, speed control means and feed rolls for engaging and feeding a wire or rod of material through a guideway opening in the combustion head and nozzle to be melted by a flame and sprayed by a blast of air onto a substrate, valve means and conduit means for supplying air to the air cap and turbine and an oxidant and fuel gas to the flame spray nozzle from regulatable sources of supply under pressure, wherein the improvement comprises:

a turbine stator situated within and fixed to the gun body and having:

an internal bore and a central axis, an internal surface extending around the bore and central axis, a plurality of fluid jet intake passages spaced at predetermined angular distances around the internal surface and bore and extending from a main fluid supply passage around the stator and through the internal surface to the internal bore, a plurality of fluid exhaust passages spaced at predetermined angular distances around the internal surface and bore and extending axially along the internal bore and internal surface to outlets adjoining a main exhaust chamber in the gun body;

seal means extending continuously around and between the stator and gun body on opposite sides of the main fluid supply passage; and a turbine rotor, including peripheral blades and pockets thereon for driving the gear train and feed rolls, rotatably mounted within the internal bore in close proximity to the internal surface of the turbine stator and rotataly driven when fluid under pressure is passed simultaneously through the plurality of fluid jet passages and directed into the pockets and against the blades of the turbine rotor fixed to rotate the input shaft of the gear train.

10. A flame spray gun according to claim 9 wherein each fluid exhaust passage is located up to one half the angular distance between a pair of fluid jet intake passages from a cooperating fluid jet passage.

11. A flame spray gun according to claim 9 wherein each fluid exhaust passages is located up to one fourth the angular distance between fluid jet intake passages from a cooperating fluid jet intake passage.

12. A flame spray gun according to claim 9 wherein both the fluid jet intake passages and the exhaust passages are substantially equally angularly spaced around the internal surface about the bore and central axis.

13. A flame spray gun according to claim 12 wherein the fluid jet intake passages and the fluid exhaust passage are angularly spaced about 120° apart and wherein each fluid exhaust passage is angularly spaced about 30° from a cooperating fluid jet intake passage.

14. A flame spray gun having a body including a base portion, a front wall portion supporting a combustion head including a flame spray nozzle and an air blast cap, and a housing portion supporting adjustable drive means including a turbine, a gear train, speed control means and feed rolls for engaging and feeding a wire or rod of material through a guideway opening in the combustion head and nozzle to be melted by a flame and sprayed by a blast of air onto a substrate, valve means and conduit means for supplying air to the air cap and turbine and an oxidant and fuel gas to the flame spray nozzle from regulatable sources of supply under pressure and wherein the combustion head comprises:

a rear inlet end portion including
a central rod guideway therethrough,
a forward outlet end portion adjoining the rear inlet portion and having
an outlet end surface,
a multiple step bore extending inwardly from the outlet end surface to the central rod guideway and having
an outer large size bore including a large annular surface adjoining the outlet end surface,
an intermediate size bore including an intermediate size annular surface adjoining the outer large size bore and large annular surface,
an inner small size bore including an inner small annular surface adjoining the intermediate size bore and annular surface and the central rod guideway,
an internal oxidant slot extending radially from the inner small bore to an oxidant conduit connected to an oxidant outlet chamber in the valve means,
an internal fuel gas slot extending radially from the intermediate size bore to a fuel gas conduit connected to a fuel gas outlet chamber in the valve means; and
an air passage extending from the outlet end surface of the combustion head to an air conduit connected to an air outlet chamber in the valve means; and wherein the flame spray nozzle comprises:

a multiple step rear portion inserted into the multiple step bore of the combustion head including
a large annular portion and surfaces extending into the outer large size bore,
an intermediate annular portion and surfaces extending from the large annular portion into the intermediate size bore, and
a smaller annular portion and surfaces extending from the intermediate annular portion into the smaller size bore,
an annular oxidant slot extending inwardly and around the smaller annular portion and connected to the internal oxidant slot in the smaller size bore,
an annular oxidant and fuel gas mixing slot extending radially inwardly around the intermediate annular portion and connected to the internal fuel gas slot in the intermediate size bore,
a plurality of oxidant injection passages extending from the oxidant slot and through the intermediate annular portion to the oxidant and fuel gas mixing slot, and
combustible mixture inclined passages converging toward each other and axis of the nozzle and extending from the oxidant fuel gas mixing slot through a frusto conical outlet end portion of the nozzle to outlets angularly spaced around a central rod guideway in the nozzle.

15. A flame spray gun according to claim 14 further comprising:

continuous seals in the large, intermediate and smaller size bores, extending around the large intermediate and small annular portions of the multiple step portion of the nozzle and situated between and on opposite sides of the oxidant slot and the oxidant and fuel gas mixing slot to prevent leakage therebetween.

16. A flame spray gun according to claim 15 wherein the continuous seals are situated in retaining grooves in the large, intermediate and smaller size bores of the step bore in the combustion head.

17. A flame spray gun according to claim 14 wherein the air blast cap comprises:

an outlet end portion including
a frustro conical bore and surface extending around and spaced from the frusto conical outlet end portion of the flame spray nozzle which provides a frustro conical annular air passage therebetween, and
an annular rear flange portion adjoining the outlet end portion and abutting the large annular portion of the flame spray nozzle and having
air passages extending therethrough from the frustro conical bore and annular air passage and connected to the air passage in the combustion head.

18. A flame spray gun according to claim 17 further comprising:

removable retaining means for clamping the air blast cap and flame spray nozzle to the combustion head.

19. A flame spray gun according to claim 18 wherein the removable retaining means comprises:

a hollow nut threaded to the combustion head and having
a front end wall portion including a central bore through which the outlet end of the air cap extends and which clamps against the annular flange of the air cap,
an outer wall extending from the front end wall portion and around a small inner air chamber and an adjoining larger outer air chamber and the forward outlet end portion of the combustion head to an opposite internal threaded end portion threaded to the combustion head, and wherein the inner air chamber is situated adjacent the front wall and connects the air passage in the flange of the air cap to the air passage in the combustion head and the outer air chamber is situated adjacent to and connects the air passage in the combustion head to an air supply conduit.

20. A flame spray gun having a gun body including a base portion, a front wall portion supporting a combustion head including a flame spray nozzle and an air blast cap, and a housing portion supporting adjustable drive means including a turbine, a gear train, speed control means and feed rolls for engaging and feeding a wire or rod of material through a guideway opening in the combustion head and nozzle to be melted by a flame and sprayed by a blast of air onto a substrate, valve means and conduit means for supplying air to the air cap and turbine and an oxidant and fuel gas to the flame spray nozzle from regulatable sources of supply under pressure, wherein the speed control means comprises:

adjustable speed regulating and sensing means mounted in the gun body adjacent to and movable relative to a turbine rotor for regulating and detecting fluctuations in speed of the turbine rotor including:
an annular magnetic cup fixed within and rotatable with the turbine rotor, a non-rotatable feed nut including an air jet orifice slideably mounted in the gun body for axial movement relative to the turbine rotor and magnetic cup, a stationary magnetic stator fixed to the gun body adjacent the turbine rotor, adjustable magnetic means cooperating with and responsive to the speed of the turbine rotor for producing varying amounts of eddy current force torque during rotation of the turbine rotor including:

a magnet rotatably mounted on the feed nut and movable axially within and relative to the magnetic stator and the rotatable magnetic cup to vary the amount of eddy current force torque and relative rotary movement of the magnet during rotation of the turbine rotor and magnetic cup about the magnet, air flow obstructing means on and rotatable with the magnet movable by the eddy current force torque relative to the air jet orifice for varying the flow of air under pressure issuing therefrom and thereby creating varying amounts of back pressure in an air supply conduit to the orifice, and throttle means including a force multiplying piston and throttle valve piston connected and responsive to the amount of back pressure in the air supply conduit for varying and adjusting the size of an air passage and volume of air to the turbine rotor and maintaining the speed of the turbine rotor and rod feed rolls at a constant preselected desired rate to which the speed regulating and sensing means has been adjusted.

21. A flame spray gun according to claim 20 wherein the throttle means comprises:

a large piston cylinder connected to the air supply conduit and air jet orifice, a large piston moveable in the large piston cylinder and responsive to the back pressure created in the air supply conduit, a throttle valve piston cylinder adjacent the large piston cylinder and having an air intake supply passage connectable to the supply of air under pressure, an air outlet passage connected to drive the turbine rotor, a throttle valve piston of smaller area and size than the large piston moveable in the throttle valve piston cylinder to vary the size of the air supply passage to the turbine rotor and connected to the large piston, a restricted air supply passage extending through the small and large pistons and connecting the throttle valve piston cylinder and the supply of air under pressure to the large cylinder, the air conduit passage and the air jet whereby air under pressure supplied to the throttle valve cylinder passes through the restricted passage in the pistons into the large cylinder to the air supply conduit and air jet and back pressure created in the air conduit reacts against the large piston to overcome a smaller force exerted by the smaller throttle valve piston and shift it to a position of equilibrium whereupon the throttle valve piston adjusts the size of the air supply passage and volume of air to the turbine rotor.

22. A flame spray nozzle head assembly adapted for melting and spraying material fed thereto onto a substrate comprising:

a combustion head including a rear inlet end portion including a central guideway therethrough, a forward outlet end portion adjoining the rear inlet portion and having an outlet end surface, a bore extending inwardly from the outlet end surface to the central guideway and having outer, intermediate, and inner surface portions, an internal oxidant slot extending radially from the inner surface portion to an oxidant supply conduit, an internal fuel gas slot extending radially from the intermediate surface portion to a fuel gas supply conduit;

a flame spray nozzle inserted into the bore of the combustion head including an outlet end portion and a rear portion including outer, intermediate, and inner portions and surfaces situated opposite the outer, intermediate, and inner surface portions of the bore, an oxidant slot in the inner portion connected to the internal oxidant slot in the bore, an oxidant and fuel gas mixing slot in the intermediate portion connected to the internal fuel gas slot in the bore, oxidant injection passages extending from the oxidant slot and through the intermediate portion to the oxidant and fuel gas mixing slot, combustible mixture passages extending from the oxidant fuel gas mixing slot through the outer and outlet end portion of the nozzle to outlets angularly spaced around a central guideway in the nozzle; and an air blast cap adjacent the nozzle including an outlet end portion, a bore and surface extending around the outlet end portion of the flame spray nozzle, and a rear portion adjoining the outlet end portion and abutting a portion of the flame spray nozzle and having an air passage extending through the rear portion from the bore and surface of the air blast cap extending around the outlet end portion of the flame spray nozzle.

23. A flame spray nozzle head assembly according to claim 22 further comprising:

continuous seals in the bore, extending around the outer, intermediate and inner portions of the rear portion of the nozzle and situated between and on opposite sides of the oxidant slot and the oxidant and fuel gas mixing slot to prevent leakage.

24. A flame spray nozzle head assembly according to claim 23 further comprising:

removable retaining means for clamping the air blast cap and flame spray nozzle to the combustion head.

25. A flame spray nozzle head assembly according to claim 24 wherein the removable retaining means comprises:

a hollow nut having a front end wall portion including a central bore through which the outlet end portion of the air blast cap extends and which clamps against the rear portion of the air blast cap, an outer wall extending from the front end wall portion and around an air chamber and the forward outlet end portion of the combustion head to an opposite end portion, and wherein the air chamber is situated adjacent the front wall and connects the air passage in the air cap to an air passage in the combustion head.

* * * * *